US005522247A

United States Patent [19]

Mitsubayashi et al.

[11] Patent Number: 5,522,247

[45] Date of Patent: Jun. 4, 1996

[54] METHOD AND APPARATUS FOR MANUFACTURING A CORRUGATED TUBE

[75] Inventors: Masahiko Mitsubayashi, Nagoya; Noritaka Miyamoto, Toyota; Keisuke Kadota, Toyota; Masazumi Onishi, Toyota; Tohru Shimada, Toyota, all of Japan

[73] Assignee: Toyota Jidosha Kabushiki Kaisha, Toyota, Japan

[21] Appl. No.: 308,441

[22] Filed: Sep. 19, 1994

[30] Foreign Application Priority Data

Sep. 20, 1993 [JP] Japan ..... 5-233792

[51] Int. Cl.[6] ..... B21D 15/06

[52] U.S. Cl. ..... 72/302; 72/342.94; 72/367

[58] Field of Search ..... 72/342.94, 342.1, 72/302, 367, 385

[56] References Cited

U.S. PATENT DOCUMENTS

| | | | |
|---|---|---|---|
| 2,347,086 | 4/1944 | Curtiss | 72/302 |
| 4,821,551 | 4/1989 | Ogino et al. . | |

FOREIGN PATENT DOCUMENTS

| | | | |
|---|---|---|---|
| 1198312 | 8/1965 | Germany | 72/302 |
| 226212 | 8/1985 | Germany | 72/302 |
| 202918 | 12/1982 | Japan | 72/342.1 |
| 59-144529 | 8/1984 | Japan . | |
| 59-191523 | 10/1984 | Japan . | |
| 63-85319 | 6/1988 | Japan . | |
| 63-157724 | 6/1988 | Japan . | |
| 63-203217 | 8/1988 | Japan . | |

*Primary Examiner*—Daniel C. Crane
*Attorney, Agent, or Firm*—Cushman, Darby & Cushman

[57] ABSTRACT

In a method and apparatus for manufacturing a corrugated tube, a tube is clamped by a pair of spaced apart chucks. A local portion of the tube is softened. The chucks are moved in the same direction such that the trailing or rearward chuck moves farther than the leading or forward chuck, thereby imparting an axially compressive force on the tube. Accordingly, a bulge is formed at the softened portion of the tube. The heating and compression cycle may be performed several times to obtain a corrugated tube having a plurality of bulges or waves formed therein.

25 Claims, 3 Drawing Sheets

METHOD AND APPARATUS FOR MANUFACTURING A CORRUGATED TUBE

BACKGROUND OF THE INVENTION

1. Field of the Invention

The present invention relates to a manufacturing method of a corrugated tube and an apparatus therefore.

2. Description of Related Art

Japanese Utility Model Publication No. SHO 63-85319 discloses a manufacturing method of a corrugated tube which comprises steps of: (a) chucking a relatively short tube at opposite ends of the tube, (b) heating the tube locally in a longitudinal direction of the tube to soften a portion of the tube, (c) imposing an axial load on the tube from opposite ends of the tube to bulge the heated portion, (d) then moving the tube forward by a predetermined distance, and (e) repeating the above (a) to (d) steps to continuously manufacture a corrugated tube.

If the above-described method is applied to a long tube to manufacture a long corrugated tube, the distance between the chucks at opposite ends of the tube is large. As a result, the tube tends to buckle or bow when axially pressed. Thus, the quality of the corrugated tube will be low. Further, because in the conventional method the pressing step and the forwarding step are in series with each other, the manufacturing time period of a corrugated tube is relatively long.

SUMMARY OF THE INVENTION

An object of the present invention is to provide a method and apparatus for manufacturing a corrugated tube, during which process the corrugated tube is unlikely to buckle and/or bow, and during which manufacturing time period is relatively short.

BRIEF DESCRIPTION OF THE DRAWINGS

The above and other objects, features, and advantages of the present invention will become more apparent and will be more readily appreciated from the following detailed description of the preferred embodiments of the present invention taken in conjunction with the accompanying drawings, in which.

DETAILED DESCRIPTION OF THE PREFERRED EMBODIMENTS

Figure 1:
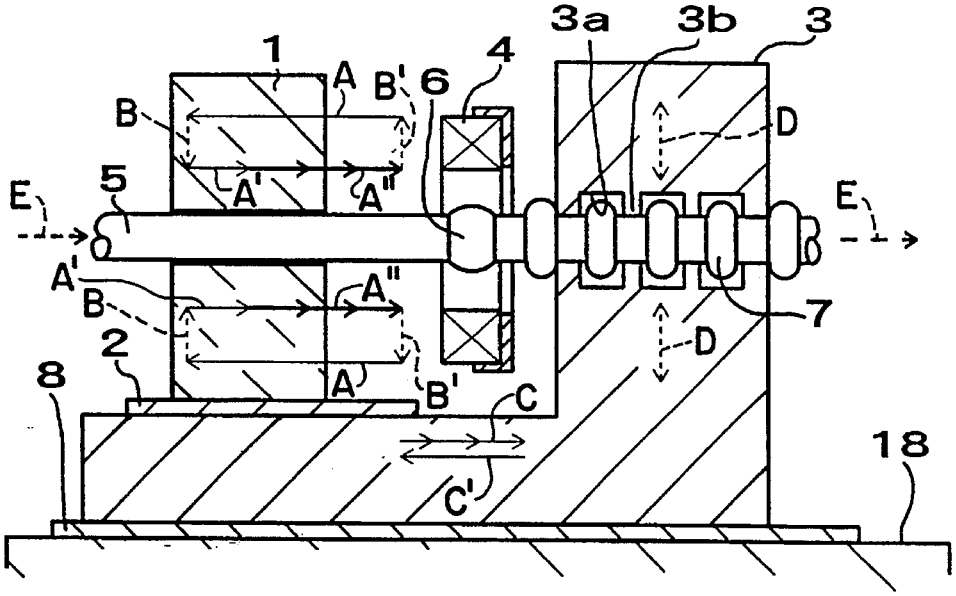
FIG. 1 is a schematic cross-sectional view of a corrugated tube manufacturing apparatus in accordance with a first embodiment of the present invention.
Figure 2:
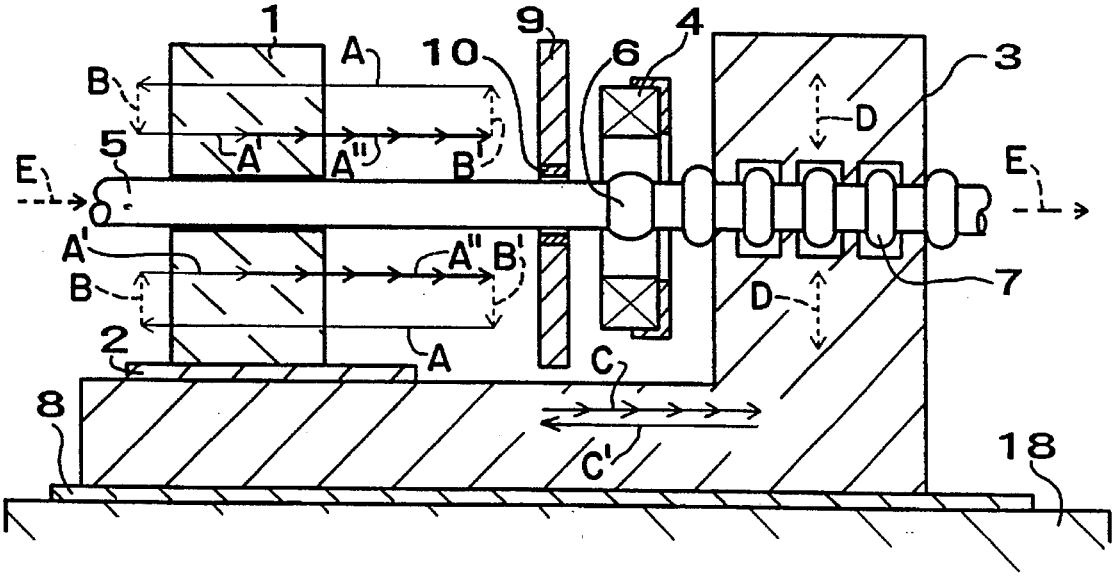
FIG. 2 is a schematic cross-sectional view of a corrugated tube manufacturing apparatus in accordance with a second embodiment of the present invention.
Figure 4:
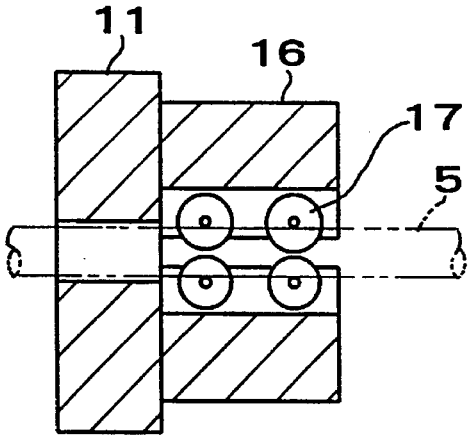
FIG. 4 is a partial enlarged cross-sectional view of a portion of the apparatus of FIG. 3 in the vicinity of a roller guide.
Figure 5:
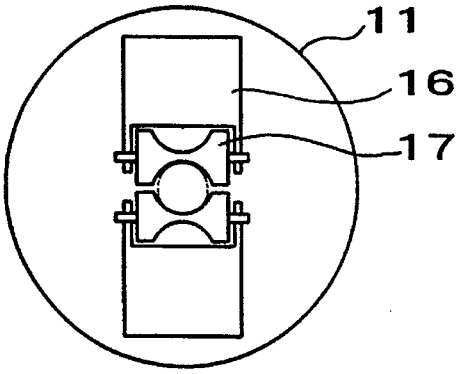
FIG. 5 is a front view of the portion of the apparatus of FIG. 4 in the vicinity of the roller guide.

The present invention includes three embodiments. A first embodiment of the present invention is a method and apparatus for manufacturing a corrugated tube wherein no guide is provided, as illustrated in FIG. 1. A second embodiment of the present invention is a method and apparatus for manufacturing a corrugated tube wherein a slidable tube guide is provided, as illustrated in FIG. 2. A third embodiment of the present invention is a method and apparatus for manufacturing a corrugated tube wherein a roller tube guide is provided, as illustrated in FIGS. 3–5.

Throughout all of the embodiments of the present invention, portions having common or similar structures are denoted with the same reference numerals.

First, structures common to all of the embodiments of the present invention will be explained with reference to FIG. 3.

Figure 3:
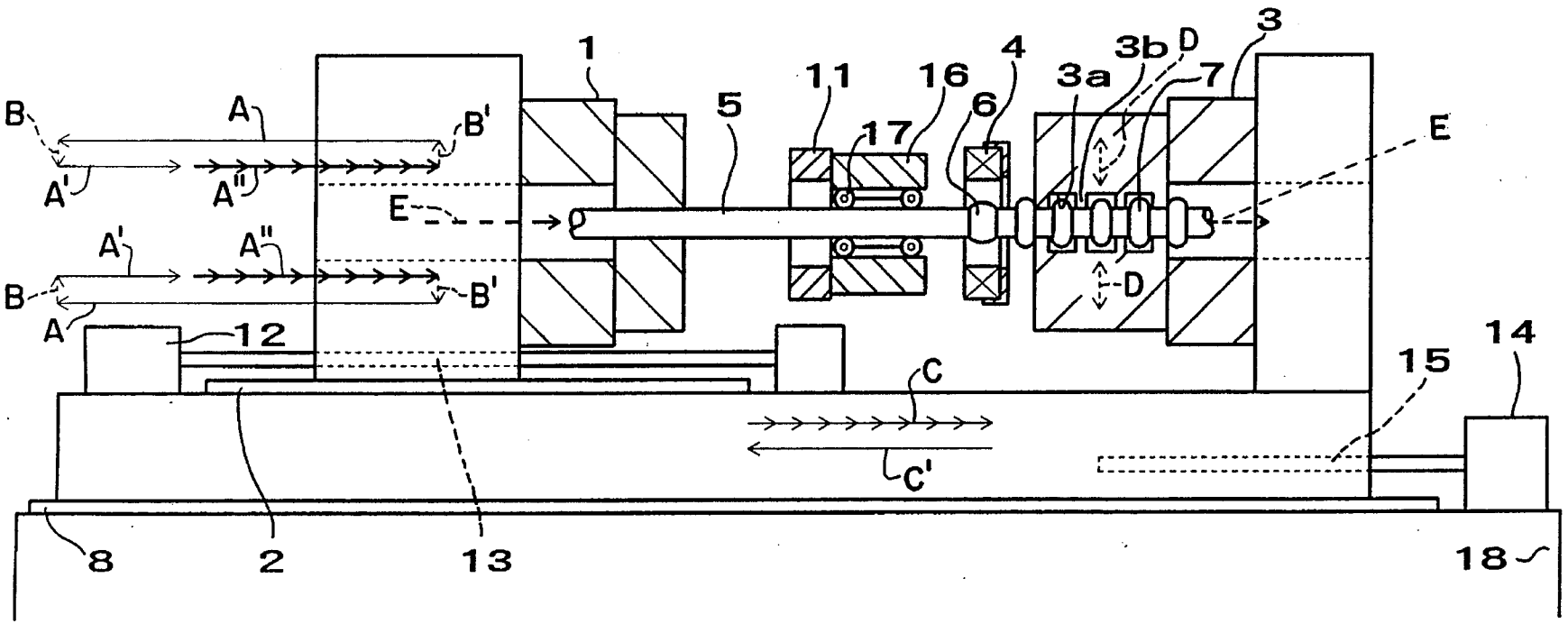
FIG. 3 is a schematic cross-sectional view of a corrugated tube manufacturing apparatus in accordance with a third embodiment of the present invention.

FIG. 3 shows a corrugated tube manufacturing apparatus in which a tube 5 which will be corrugated is set. A portion 7 of the tube 5 has been already corrugated or wave-formed. In the case of a corrugated tube used for an automobile oil cooler, for example, an aluminum alloy (JIS-A3003) tube having an outside diameter of 12.7 mm and a thickness of 1.2 mm is used for the tube 5. When the tube 5 has been corrugated, the corrugated tube has an outside diameter of 18 mm measured at a radial crest of a wave or bulge of the corrugated tube.

Figure 6:
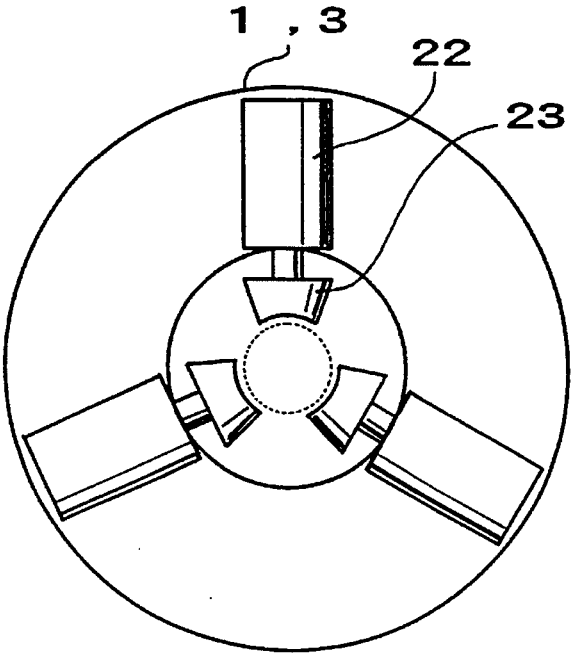
FIG. 6 is a front view of chucks used in the apparatuses of FIGS. 1–3.

The tube 5 has opposite ends and an intermediate portion between the opposite ends. The tube 5, which is disposed horizontally for example, is clamped and supported at the intermediate portion of the tube 5 by a pair of chucks 1 and 3. The tube 5 is clamped at two positions spaced from each other in a longitudinal direction of the tube 5 by respective chucks i and 3 from outside of the tube 5. A forward chuck 3, relative to a forwarding direction of the tube 5, (see arrows E in FIG. 3) is a fixing chuck for fixedly clamping the tube 5. Rearward chuck 1, relative to the forwarding direction of the tube 5, is a pressing chuck for clamping the tube 5 and also for moving the tube 5 relative to the fixing chuck 3 to impose an axial compressive load on a portion of the tube 5 between the pair of chucks 1 and 3. As illustrated in FIG. 6, each chuck 1, 3 includes a plurality of jaws 23, and at least one hydraulic cylinder 22 for moving the jaws 23 toward and away from the tube 5 in a direction perpendicular to the longitudinal direction of the tube 5. When the jaws 23 are pressed against the tube 5, the chucks 1, 3 clamp the tube 5 from outside thereof.

The fixing chuck 3 is slidably movable forward (arrow c) and backward (arrow c') relative to a static base 18, via a slide 8 extending in the longitudinal direction of the tube 5. The fixing chuck 3 includes a chucking body having a plurality of grooves **3*a* spaced from each other at a pitch of bulged portions of the wave-formed portion 7 of the tube 5. This prevents the bulged portions of the tube 5 from interfering with the chucking body of the fixing chuck 3. The chucking body also has a plurality of chucking portions 3*b* formed between adjacent grooves 3*a* for chucking the tube 5 at portions between the bulged portions 7. The fixing chuck 3 operates along the line of direction as indicated by arrows D in FIG. 3. The pressing chuck 1 is mounted on the fixing chuck 3 and is movable forwardly (arrows A' and A" in FIG. 3) and backwardly (arrows A in FIG. 3) relative to the fixing chuck 3 by a slide 2. The pressing chuck 1 clamps a straight (i.e., not yet bulged) portion of the tube 5 (see arrows B and B' in FIG. 3). When the fixing chuck 3 and the pressing chuck 1 are simultaneously moved in the same direction to bulge one wave portion of a corrugated tube, the forward, fixing chuck 3 is moved by one pitch of waves of a corrugated tube. The rearward, pressing chuck is moved by a sum of the movement amount of the fixing chuck 3 plus a movement amount of the pressing chuck 1 relative to the fixing chuck 3** (arrow A' plus arrow A").

The fixing chuck 3 is driven by a servo motor 14 via a ball screw 15 mounted on the base 18. The pressing chuck 1 is driven by a servo motor 12 fixed to the fixing chuck 3 via a ball screw 13. The servo motors 14 and 12 and the respective ball screws 15 and 13 are one example of drive means for driving the chucks 1 and 3 and may be replaced by another driving mechanism. For clarity, the servo motors and the ball screws are not shown in FIGS. 1 and 2.

Figure 7:
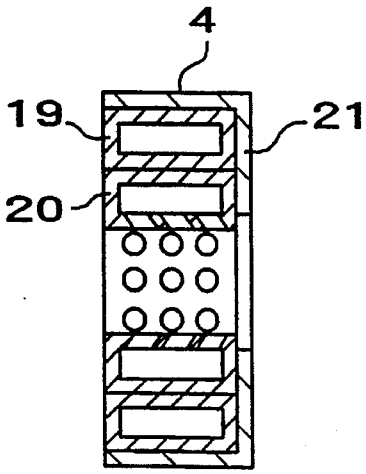
FIG. 7 is a cross-sectional view of a heating and cooling device used in the apparatuses of FIGS. 1–3.

A heating and cooling device 4 is provided between the fixing chuck 3 and the pressing chuck 1 which surrounds a portion of the tube 5 between the two clamping positions. The heating and cooling device 4 heats, then cools, a local portion of the tube 5 in the longitudinal direction of the tube 5. As illustrated in FIG. 7, the heating and cooling device 4 includes an coil 19 for carrying a high-frequency electric current and for induction-heating the tube 5, a duct 20 disposed radially inside of the coil 19 for jetting a cooling liquid (for example, water), against the portion of the tube 5 inside the duct 20, and an electrical insulating member 21 for insulating bulged portions 7 of the tube 5. The coil 19 is constructed of copper coil having a rectangular hollow cross section. A high frequency electric current flows through the copper coil, and a cooling liquid for cooling the coil flows through a hollow space of the coil 19. The duct 20 has many apertures for jetting cooling water therethrough to rapidly cool the heated and bulged portion of the tube 5. The insulating member 21 is provided on a front side of the coil 19 (i.e., in the tube forwarding direction) and insulates the bulged portions 7 of the tube 5 from a high-frequency induced magnetic field generated by the coil 19, preventing the already-bulged portions of the tube from being induction-heated. The heating and cooling device 4 is a static member and is supported on the static base 18, or by a static ceiling member, or the like.

A guide for supporting the tube 5 and for preventing it from deforming in a direction perpendicular to the longitudinal direction of the tube 5 may be provided between the heating and cooling device 4 and the rearward pressing chuck 1. Such a guide is not provided in the first embodiment of the present invention, but a bush-type tube guide is provided in the second embodiment of the present invention and a roller-type guide is provide in the third embodiment of the present invention, which will be explained in more detail hereinafter.

Next, steps of a corrugated tube manufacturing method (operation of the apparatus described above) common to all of the embodiments of the present invention will be explained with reference to, for example, FIG. 3.

The method of manufacturing a corrugated tube from a smooth tube 5 having opposite ends and an intermediate portion between the opposite ends includes steps of: clamping the tube 5 in chucks 1 and 3; repeatedly heating and incrementally moving the pair of chucks 1 and 3 to bulge a heated portion of the tube so that a plurality of waves or bulges are formed in the tube 5; and unclamping the tube 5 and returning the chucks 1 and 3 to respective original positions. Between the instant chucking of the tube 5 by the chucks 1 and 3 and the next chucking of the tube 5 by the chucks 1 and 3, a plurality of bulged portions (waves) 7 are formed in the tube 5, and, by repeating formation of the plurality of bulged portions over a substantially entire length of the tube 5, a corrugated tube is manufactured. Each step will be explained in more detail below.

During the step of chucking, the tube 5 is clamped at an intermediate portion. The intermediate portion of the tube 5 is clamped by chucks 1 and 3 at two positions spaced from each other in the longitudinal direction of the tube 5. More particularly, the tube 5 is clamped at a front portion by the fixing chuck 3, which is movable in the longitudinal direction of the tube 5. The tube 5 is clamped at a rear portion by the pressing chuck 1, which is movable relative to the fixing chuck 3. The fixing chuck 3 and the pressing chuck 1 clamp the tube 5 by moving all of the jaws 23 (seen in FIG. 6) with the at least one hydraulic cylinder 22 to press the jaws 23 against the tube 5.

Then, during the heating step, a portion of the tube 5 between the pair of chucks 1 and 3 is locally heated in the longitudinal direction of the tube 5 by high-frequency induction heating. In tests, an anode voltage was 8 KV and an anode electric current was 12 A. In the case of an aluminum tube having an outside diameter of 12.7 mm and a thickness of 1.2 mm, the tube 5 was locally heated to 550°–650° C. within about one second. The induction heating is then stopped, and the pair of chucks 1 and 3 are moved simultaneously in the same direction such that the pressing chuck 1 moved a longer distance than the fixing chuck 3, thereby bulging out one wave 7 of a corrugated tube. The chucks 3 and 1 are moved by the servo motors 14 and 12. Since the pressing chuck 1 is mounted on the fixing chuck 3, movement of the fixing chuck 3 moves the pressing chuck 1 by the same amount if the pressing chuck 1 is not also moved relative to the fixing chuck 3. In order to apply an axial load on the tube 5, the pressing chuck 1 is moved relative to the fixing chuck 3 so that the heated (and, thus, softened) portion of the tube is axially pressed to be bulged. Further, by the simultaneous movement of the pressing chuck 1 and the fixing chuck 3, simultaneous with the bulging, the heated portion is moved forward by one bulge width of the corrugated tube, so that the next portion of the tube to be heated comes to the heating position. Since the axial pressing and forwarding of the tube 5 are conducted simultaneously, the manufacturing time period is greatly shortened compared with the conventional method wherein axial pressing and forwarding of a tube are conducted in sequence. In testing, bulging one segment and then incrementally forwarding the tube was conducted within about 0.4 sec. Next, the forward motion of the tube 5 is stopped and a cooling liquid is jetted from the duct 20 onto the most recently heated and bulged portion of the tube 5 to cool the heated and bulged portion of the tube for about 1.1 sec. A total time period necessary to bulge one wave and move the tube 5 forward by one wave is about 2.5 sec, namely, a summation of 1 sec for heating, 0.4 sec for simultaneous pressing and forwarding, and 1.1 sec for cooling.

Then, without changing the chucking, the cycle of heating, bulging, and cooling is repeated several times. Therefore, a plurality of waves in a corrugated tube is formed without changing the chucking. In the conventional method, the chucking is changed after one cycle of heating, bulging, and cooling. The change of chucking requires about four to five seconds. Since the chucking only has to be changed after several cycles in the present invention, the time period for manufacturing the corrugated tube is greatly shortened.

During the step of releasing the clamping and returning the chucks, the tube 5 is released by the chucks 1 and 3, then the chucks 1 and 3 are returned to their original positions, leaving the tube 5 at its position. In this instance, the chucks 1 and 3 may release their clamping simultaneously, or one of the chucks may release its hold first, followed by the other chuck.

Then, the above cycle of clamping, heating, bulging, cooling, and unclamping is conducted repeatedly until the entire portion of the tube 5 is formed into a corrugated tube.

Next, structures and steps unique to each embodiment will be explained.

In the first embodiment of the present invention, as illustrated in FIG. 1, a tube guide is not provided between the heating and cooling device 4 and the pressing chuck 1. In this instance, if many waves/bulges are formed during each chucking procedure, the distance between the heating and cooling device 4 and the pressing chuck 1 is long. As a result, buckling may occur and press-forming the tube will be unstable. Therefore, the number of waves formed during each chucking procedure should be limited to four or five at most. Manufacturing a corrugated tube in accordance with the method according to the first embodiment of the present invention takes about half the time for manufacturing a corrugated tube in accordance with the conventional method.

In the second embodiment of the present invention, as illustrated in FIG. 2, a static bushing-type tube guide 10 is provided between the heating and cooling device 4 and the pressing chuck 1. The guide 10 is coupled to a support plate 9 supported from, for example, a static ceiling member (not shown). In a case where an outer diameter of the tube is, for example, 12.7 mm, an inner diameter of the guide 10 is selected to be 12.8 mm. By providing the guide 10, the distance between points supporting the tube 5 is a half of the distance where no such guide is provided. Thus, the tube 5 can bear an axial load about four times that in the case of having no guide. Manufacturing the tube 5 in this case is therefore stable.

To prevent induction-heating of the guide 10 and support plate 9, the guide 10 is constructed of, for example, brass, and the support plate 9 is constructed of stainless steel. The guide 10 is supported from the support plate 9 via a screw, and by adjusting the screw the position of the guide 10 can be adjusted.

Since provision of the guide 10 makes manufacturing of a corrugated tube stable, about eight to ten waves can be formed during a single chucking procedure. A time period for manufacturing the corrugated tube according to the second embodiment of the present invention is shortened to one third of the time needed for the conventional method.

In the third embodiment of the present invention, as illustrated in FIG. 3, a roller tube guide 11 is provided between the heating and cooling device 4 and the pressing chuck 1. The roller guide 11 includes a plurality of rollers 17 and roller supporting blocks 16 which are movable in a direction perpendicular to the longitudinal direction of the tube and can be biased toward the tube 5, for example, by cylinder supports (not shown). The rollers 17 directly contact the tube 5 and support the tube 5 without a clearance therebetween. A small clearance is necessary to allow the tube to move relative to the bushing guide 10, while with the roller guide 11, no clearance has to be provided. Therefore, the formation is even more stable than that of the second embodiment, and ten or more waves can be formed during each chucking procedure. A time period for manufacturing a corrugated tube is shortened to a time period equal to or less than 32% of the time period needed for the conventional method.

According to the present invention, the following advantages are obtained:

First, since the tube is clamped at its intermediate portion and not at its opposite ends, a distance between the pair of chucks is short, so bulging the tube is stable and without buckling when the tube axially pressed. This stable formation raises a quality of the manufactured corrugated tube.

Second, since axially pressing a heated portion of the tube and incrementally moving the tube forward are done simultaneously by moving the pair of chucks simultaneously, the time to manufacture the corrugated tube is greatly shortened, compared with a conventional method where pressing and forwarding are conducted sequentially.

Third, since a plurality of waves or bulges are formed during each chucking procedure, the time period for manufacturing a corrugated tube is again shortened.

Fourth, when a guide is provided between the heating and cooling device and the rear pressing chuck, the distance between points supporting the tube is shortened, so buckling is unlikely to occur. As a result, the number of waves which can be formed during each chucking procedure is large, and the time period for manufacturing the corrugated tube is further shortened.

Although certain embodiments of the present invention have been described in detail above, it will be appreciated by those skilled in the art that various modifications and alterations can be made to the particular embodiments shown without materially departing from the novel teachings and advantages of the present invention. Accordingly, it is to be understood that all such modifications and alterations are included within the spirit and scope of the present invention as defined by the following claims.

What is claimed is:

1. A method of manufacturing a corrugated tube from a generally smooth tube having a longitudinal direction, opposite ends, and an intermediate portion between the opposite ends, the method comprising steps of:

clamping the intermediate portion of the tube at two spaced apart positions with respective chucks;

repeatedly performing the steps of:

(a) heating a part of the intermediate portion with a heating device to soften the part of the intermediate portion; and (b) moving each respective chuck in the same direction, such that a rearward chuck is moved for a longer distance than a forward chuck to cause a bulge to form at the softened part of the intermediate portion.

2. A method according to claim 1, wherein the forward chuck is a fixing chuck that is movable in the longitudinal direction of the tube and the rearward chuck is a pressing chuck that is movable in the longitudinal direction of the tube relative to the fixing chuck.

3. A method according to claim 1, wherein each of the chucks includes a plurality of jaws and at least one hydraulic cylinder for actuating the plurality of jaws against the tube, wherein during said step of clamping the tube, the jaws are moved toward and are pushed against the tube by actuating the at least one hydraulic cylinder.

4. A method according to claim 1, wherein said step of heating a part of the tube is performed through high-frequency induction heating.

5. A method according to claim 1, wherein during said step of repeatedly performing said steps of heating a portion of the tube and moving each respective chuck in the same direction, the forward chuck is moved by the width of a bulge to be formed in the tube.

6. A method according to claim 1, wherein during said step of repeatedly performing said steps of heating a portion of the tube and moving each respective chuck in the same direction, the rearward chuck is moved over a distance equal to a distance that the forward chuck is moved plus a distance of relative movement between the rearward chuck and the forward chuck during a cycle of said heating step and said moving step.

7. A method according to claim 1, wherein the forward and rearward chucks are coupled to respective servo motors, wherein during said step of repeatedly performing said steps of heating a portion of the tube and moving each respective chuck in the same direction, the forward and rearward chucks are driven by the respective servo motors to thereby move the forward and rearward chucks.

8. A method according to claim 1, wherein during said step of repeatedly performing said steps of heating a portion of the tube and moving each respective chuck in the same direction, said heating and said moving steps are repeatedly performed between 4 and 12 times.

9. A method according to claim 1, wherein a slidable guide is disposed between the rearward chuck and the heating device, and wherein during said step of repeatedly performing the steps of heating a portion of the tube and moving each respective chuck in the same direction, the tube is slidably supported by the slidable guide between the rearward chuck and the heat heating device.

10. A method according to claim 1, wherein a roller guide is disposed between the rearward chuck and the heating device, and wherein during said step of repeatedly performing the steps of heating a portion of the tube and moving each respective chuck in the same direction, the tube is supported by the roller guide between the rearward chuck and the heating device.

11. A method according to claim 1, further comprising a step of releasing the tube from the respective chucks and returning the respective chucks to respective positions assumed prior to said moving step.

12. A method of manufacturing a tube having a bulged portion from a tube having a longitudinal direction, opposite ends, and an intermediate portion between the opposite ends, the method comprising steps of:

clamping the intermediate portion of the tube at two spaced apart positions with respective chucks; and performing the steps of:

(a) heating a part of the intermediate portion with a heating device to soften the part of the intermediate portion; and (b) moving each respective chuck in the same direction, such that a rearward chuck is moved for a longer distance than a forward chuck to cause a bulge to form at the softened part of the intermediate portion.

13. An apparatus for manufacturing a corrugated tube from a generally smooth tube having a longitudinal direction, opposite ends, and an intermediate portion between the opposite ends, the apparatus comprising:

a pair of chucks movable along the longitudinal direction of the tube and spaced from each other along the longitudinal direction of the tube, said chucks being constructed and arranged to clamp the intermediate portion of the tube at spaced apart positions;

driving devices for moving said pair of chucks forwardly and backwardly, respectively, such that when said pair of chucks are moved forwardly, a rearward chuck of said pair of chucks is moved over a longer distance than a forward chuck; and a heating and cooling device, disposed between said pair of chucks, for heating and then cooling a part of the intermediate portion of the tube.

14. An apparatus according to claim 13, further comprising a tube guide disposed between the heating and cooling device and said rearward chuck, said tube guide supporting the tube and preventing the tube from being deformed in a direction perpendicular to the longitudinal direction of the tube.

15. An apparatus according to claim 13, wherein said forward chuck comprises a fixing chuck movable in the longitudinal direction of the tube, and said rearward chuck comprises a pressing chuck movable relative to the forward chuck in the longitudinal direction of the tube.

16. An apparatus according to claim 13, wherein each chuck of said pair of chucks includes a plurality of jaws and an at least one hydraulic cylinder for moving the plurality of jaws toward and away from the tube.

17. An apparatus according to claim 15, wherein said pressing chuck is movably mounted on said fixing chuck such that said pressing chuck is movable relative to said fixing chuck.

18. An apparatus according to claim 13, wherein said pair of chucks are coupled to respective servo motors so that said pair of chucks are driven thereby.

19. An apparatus according to claim 13, wherein said forward chuck includes a chucking body having:

a plurality of grooves spaced from each other at a pitch corresponding to bulged portions formed in the tube, said grooves preventing the bulged portions from interfering with the chucking body of the forward chuck; and a plurality of chucking portions, each formed between adjacent grooves for chucking said tube at portions of the tube between the bulged portions of the tube.

20. An apparatus according to claim 13, wherein said heating and cooling device includes a coil for allowing a high frequency electric current to flow therethrough, a duct disposed radially inside of said coil for jetting water toward a portion of the tube at least partially surrounded by said duct, and an electrical insulating member for insulating bulged portions of the tube from said coil.

21. An apparatus according to claim 13, wherein said heating and cooling device is supported from a static ceiling member.

22. An apparatus according to claim 14, wherein said guide comprises a bushing guide for slidably supporting the tube.

23. An apparatus according to claim 22, wherein said bushing guide is supported from a static ceiling member via a plate supported by the static ceiling member.

24. An apparatus according to claim 23, wherein said bushing guide is constructed of brass, and said plate is constructed of stainless steel.

25. An apparatus according to claim 14, wherein said guide comprises a roller guide having a plurality of rollers which rotatably contact the tube.

* * * * *